US007425082B1

(12) United States Patent
Jones

(10) Patent No.: US 7,425,082 B1
(45) Date of Patent: Sep. 16, 2008

(54) ROTATABLE LIGHT ASSEMBLY

(76) Inventor: Theodore D. Jones, 321 Gun Club Rd., N., Independence, OR (US) 97351

( * ) Notice: Subject to any disclaimer, the term of this patent is extended or adjusted under 35 U.S.C. 154(b) by 29 days.

(21) Appl. No.: 11/346,820

(22) Filed: Feb. 3, 2006

Related U.S. Application Data

(63) Continuation-in-part of application No. 10/799,805, filed on Mar. 12, 2004, now abandoned.

(51) Int. Cl.
*F21V 21/26* (2006.01)

(52) U.S. Cl. ..... 362/285; 362/269; 362/287

(58) Field of Classification Search ..... 362/190–191, 362/396, 285, 427
See application file for complete search history.

(56) References Cited

U.S. PATENT DOCUMENTS

| | | | | |
|---|---|---|---|---|
| 5,180,220 | A * | 1/1993 | Van Kalsbeek | 362/98 |
| 6,419,370 | B1 * | 7/2002 | Chen | 362/98 |
| 6,619,813 | B1 * | 9/2003 | Schnell | 362/116 |

FOREIGN PATENT DOCUMENTS

| | | | |
|---|---|---|---|
| JP | 10283802 | * | 10/1998 |

* cited by examiner

*Primary Examiner*—Ali Alavi
(74) *Attorney, Agent, or Firm*—Timothy E. Siegel Patent Law, PLLC

(57) ABSTRACT

A light assembly, comprising a clip and a base, releasably engageable to said clip. A platform is rotatably mounted to said base. In addition, a post is mounted on said platform and has a top. A light is hinged to said top of said post.

13 Claims, 4 Drawing Sheets

ROTATABLE LIGHT ASSEMBLY

RELATED APPLICATIONS

This application is a continuation in part of U.S. application Ser. No. 10/799,805 which was filed Mar. 12, 2004 now abandoned.

BACKGROUND OF THE INVENTION

There are a number of problems with currently available helmet lights. The light itself tends to be large and heavy. Also, as the light may protrude ten centimeters or more from the helmet, and does not easily disconnect, it presents a snagging hazard. For firefighters and others who rely on helmet lights, a snagging hazard could be deadly, as it could force the firefighter to either stay in place at a dangerous moment, or proceed without his helmet, a much needed item.

In addition, although helmet mounting fixtures for illumination sources (typically a flashlight) with many degrees of freedom of adjustment appear to be available, the relatively large mass of the typical flashlight requires that the joints of these fixtures be fairly stiff, to hold the flashlight in a stationary orientation during normal use. This means, however, that when it is desired to change the direction in which the light is pointing, it is necessary to exert a relatively large force on the flashlight to overcome the joint stiffness. Alternatively, the firefighter may need to loosen a fastening screw in order to adjust the angle of the light. This may be very difficult to do when wearing the heavy gloves that firefighters wear when confronting a blaze. In emergency situations every second and every motion may be important. Accordingly, if it takes longer to make an adjustment than would otherwise be necessary this could make a difference to the overall success of the emergency response operation.

Moreover, a firefighter's suite of equipment presents a heavy burden to a firefighter. Accordingly, it is undesirable to add to this burden with the currently existing systems that permit multi-axis adjustment of the illumination source, as every additional gram of mass is an added burden to the firefighter.

SUMMARY OF THE INVENTION

In a first preferred embodiment, the present invention takes the form of a light assembly, comprising a clip and a base, releasably engageable to said clip. A platform is rotatably mounted to said base. In addition, a post is mounted on said platform and has a top. A light is hinged to said top of said post.

In a second preferred embodiment, the present invention takes the form of a light assembly having a base, having an area of at least 2 $cm^2$, and a platform rotatably mounted on the base. A post is mounted on the platform, has a top, and is between 1 cm and 3 cm in height. A light is vertically hinged to the top of the post.

The foregoing and other objectives, features and advantages of the invention will be more readily understood upon consideration of the following detailed description of the preferred embodiment(s), taken in conjunction with the accompanying drawings.

DETAILED DESCRIPTION OF THE PREFERRED EMBODIMENT(S)

Figure 1:
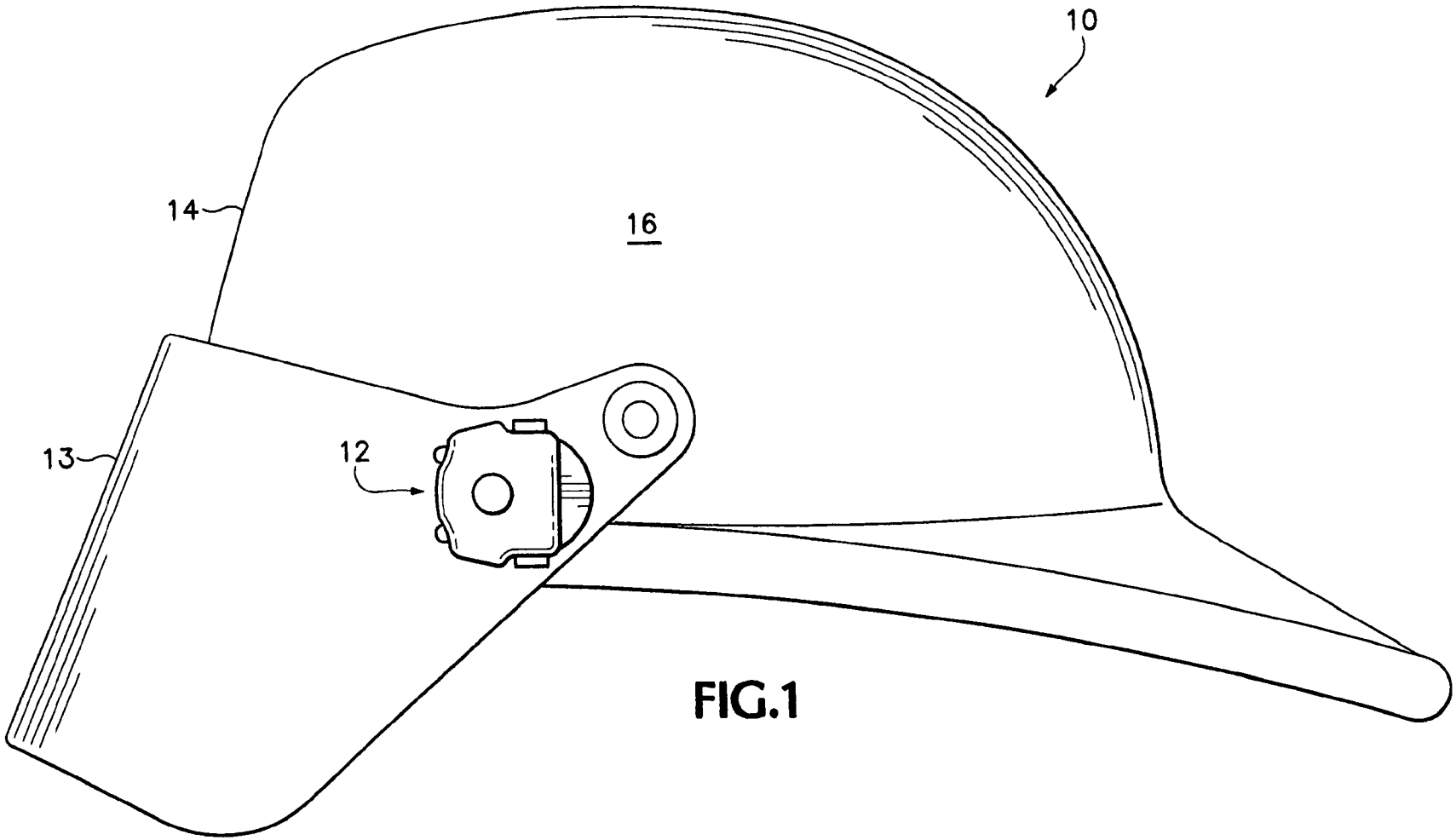
FIG. 1 is a side view of a helmet having an illumination source assembly, according to the present invention.

Referring to FIG. 1, in a preferred embodiment a helmet 10 having a visor 13, is equipped with a rotatable illumination source assembly 12. Although the assembly 12 is shown attached to the visor 13 of the helmet 10, in alternative preferred embodiments it is attached to the front face 14 or the side 16 of the helmet 10.

Figure 2:
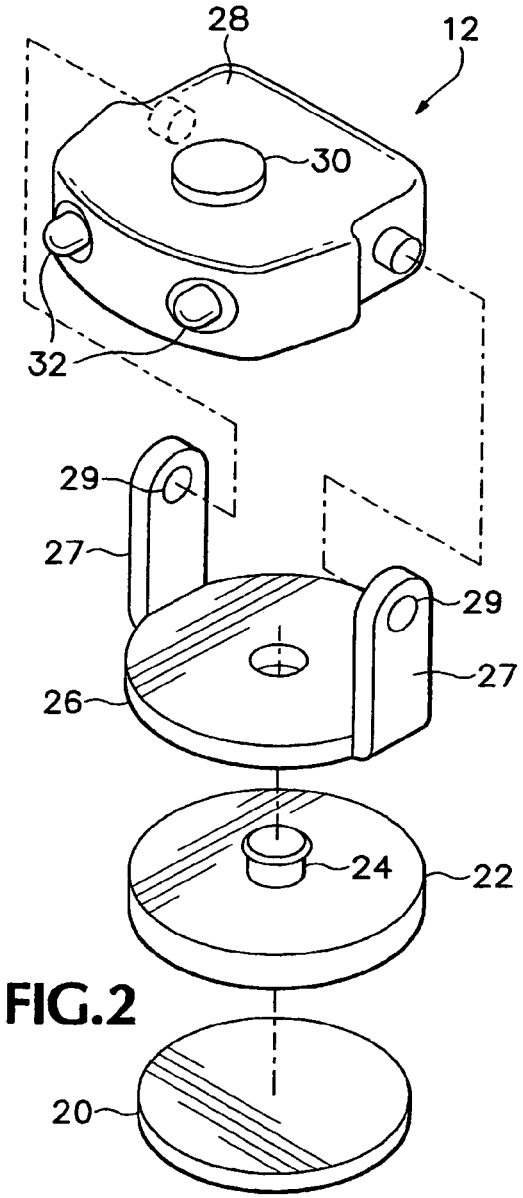
FIG. 2 is an exploded isometric view of the illumination source assembly of FIG. 1.
Figure 3:
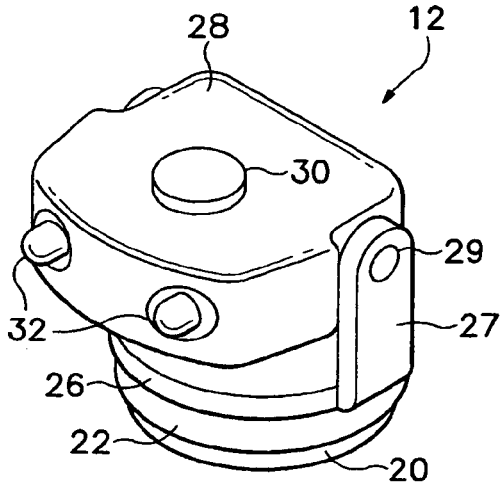
FIG. 3 is an isometric view of the illumination source assembly of FIG. 1, showing the assembly in a first position.
Figure 4:
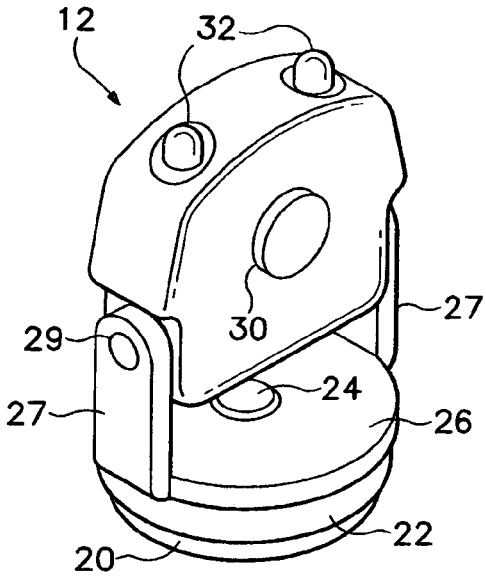
FIG. 4 is an isometric view of the illumination source assembly of FIG. 1, showing the assembly in a second position.

Referring to FIGS. 2-4, assembly 12 includes a compressibly deformable adhesive element 20, adapted to facilitate the attachment of assembly 12 to a helmet. A helmet may indeed be easily retrofitted to include assembly 12 simply by adhering assembly 12 to the desired portion of the helmet.

Attached to adhesive element 20 is a post bearing structure 22, which together with element 20 forms a base. An illumination source mounting element 26 having two arms 27 is rotatably mounted about post 24 of structure 22. In turn an illumination source 28 is rotatably mounted by way of apertures 29 in arms 27 of mounting element 26. Mounting element 26 can be rotated 360° about post 24 and the illumination source 28 can be rotated approximately 200° about the axis defined by apertures 29.

Illumination source 28 is preferably a flashlight having a push-toggle on-off switch 30 and two light emitting diodes 32, and has a mass of about 30 grams (weighs slightly more than an ounce). Additionally, illumination source 28 is in the form of a slightly modified solid rectangle having a length of about 3.5 cm (1.38 in), a width of about 3 cm (1.2 in) and a thickness of about 1 cm (0.4 in). Assembly 12 is preferably made of lightweight polymer material having a relatively low strength, so that it will break easily and not constitute a snagging hazard. Moreover, the entire assembly 12 protrudes from the side of the helmet by less than 3 cm (1.2 in), far less than other available illumination source assemblies. Moreover, it is not necessary to loosen any element in order to change the pointing direction of illumination source 28.

The advantages of this arrangement should now be evident. Because source 28 is so lightweight, its inertia is low and it can be mounted in a less rigid manner than heavier flashlights. This is an important advantage to an emergency response person who may need to very quickly change the direction in which source 28 is pointing. Moreover, because it is lightweight, source 28 assembly 12 can be made of polymer material, which will easily break or snap off in the event that an element of source 28 becomes snagged on a protrusion. Such an incident can prove fatal to a firefighter, as it forces him to lose precious seconds and/or could result in his proceeding without his helmet. In one preferred embodiment, assembly 12 breaks or snaps off the remainder of helmet 10 under a torque of greater than 1 newton meter. In an alternative preferred embodiment, assembly 12 breaks or snaps off under a torque of greater than 10 newton meters. In yet another preferred embodiment, assembly 12 breaks or snaps off under a torque of greater than 100 newton meters. In still another alternative preferred embodiment, assembly 12 breaks or snaps off under a torque of greater than 0.1 newton meters. In a yet further alternative preferred embodiment, assembly 12 breaks or snaps off under a torque of greater than 1000 newton meters.

Figure 5:
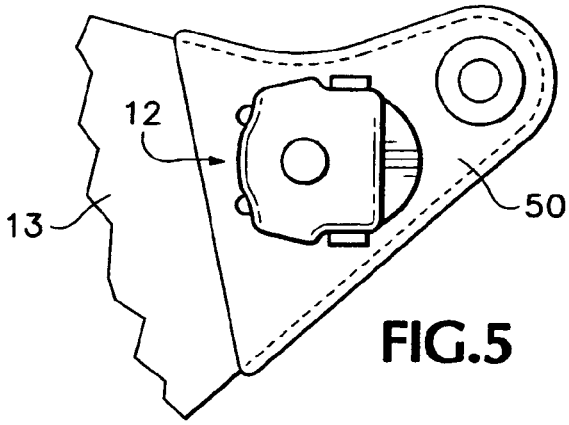
FIG. 5 is a side view of an alternative preferred embodiment of an illumination source assembly clipped to a corner of a helmet visor.

Referring to FIG. 5, in an alternative preferred embodiment, assembly 12 is provided joined to a clip 50 that mechanically attaches (clips) to a corner of the visor 13, without the use of adhesives.

Figure 6:
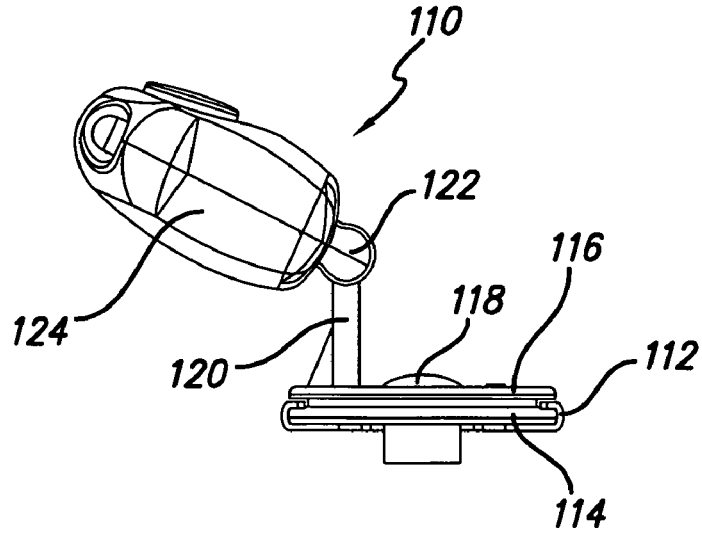
FIG. 6 is a side view of an additional alternative preferred embodiment of an illumination source assembly according to the present invention.
Figure 7:
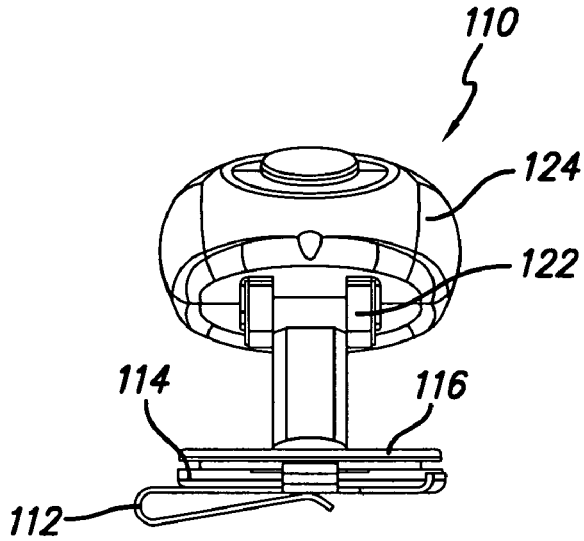
FIG. 7 is a side view, rotated 90° from the view of FIG. 6 of the illumination source assembly of FIG. 6.
Figure 8:
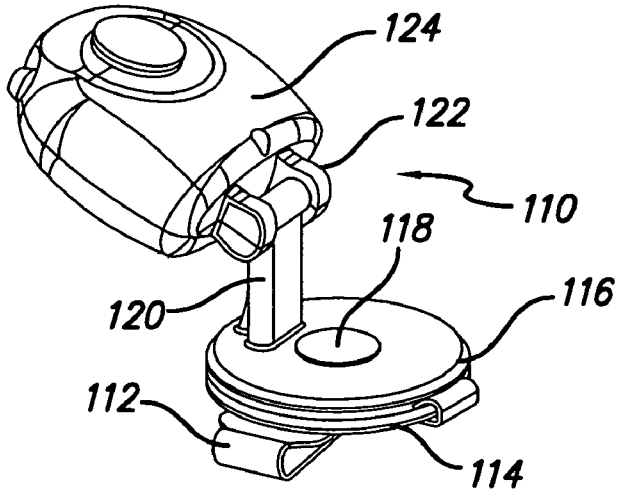
FIG. 8 is a top perspective view of the illumination source assembly of FIG. 6.

Referring to FIGS. 6-8, in an alternative preferred embodiment, a light assembly 110 is adapted to be clipped to any convenient planar object, such as an automobile visor. A clip 112 slidably accepts and retains a base 114, to which a platform 116 is rotatably mounted by a way of a center pin device 118. A post 120 rises from platform 116 and is topped with a hinge 122, which supports a light 124.

Figure 10:
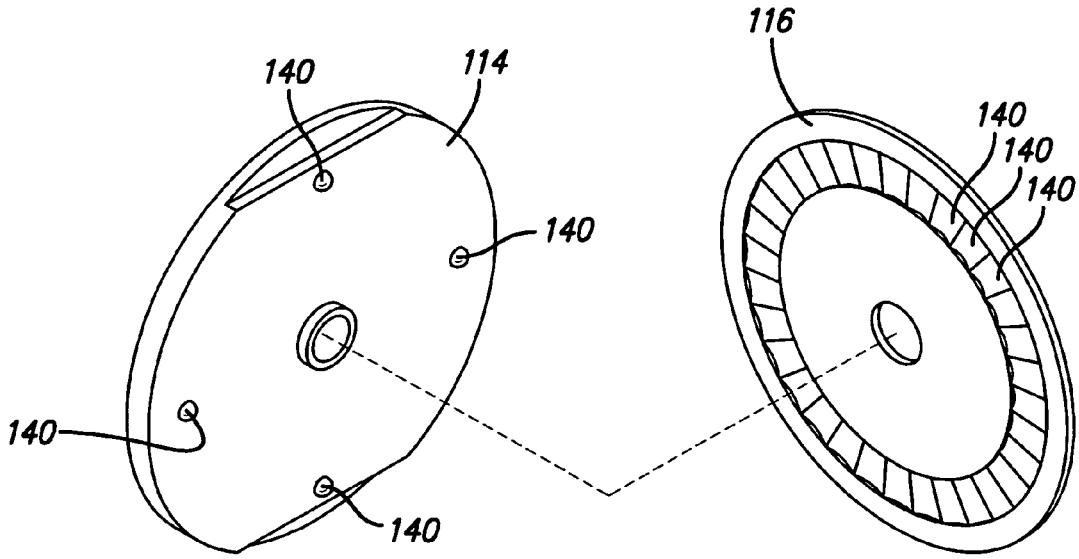
FIG. 10 is a perspective exploded view of the rotatable platform of the illumination source assembly of FIG. 6.

In a preferred embodiment center pin device 118, includes between about 20 and 30 discrete resistance points (ratchets), so that platform 116 may be rotated in fixed steps. In a more specific preferred embodiment it ratchets every 15° to provide 24 fixed positions over a complete circle. FIG. 10 shows the mechanism by which, as skilled persons will readily recognize, these ratchets are implemented, by way of ratchet elements 140. Additionally, the hinge 122 ratchets every 20 degrees for 20 positions in all over its 220° freedom of movement. In an alternative preferred embodiment, one or both of these hinges has smooth movement, without any ratcheting.

Figure 9:
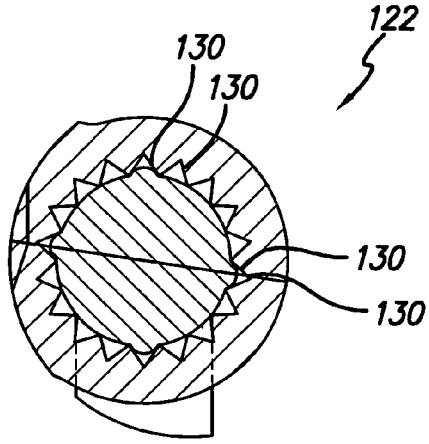
FIG. 9 is a detail sectional view of the hinge of the illumination source assembly of FIG. 6.

FIG. 9 shows the mechanism by which, as skilled persons will readily recognize, these ratchets are implemented, by way of ratchet elements 130.

Assembly 110 is particularly well adapted for providing a light that is temporarily fixed in a particular location, but may be easily removed and used in a mobile capacity. For example assembly 110 may be clipped to a car visor and used in a car as an additional reading light. Base 114 could be easily removed from clip 112 and taken out when, for example, the car breaks down at nighttime. In the event that there is an immediate need to repair some part of the car, for example a tire, base 114 could be used to stand assembly 110 on the ground, and post 120 would hold light 122 above the ground and permit the beam to be pointed upward.

In another mode of usage, hook or loop material can be adhered to clip 112 and be mated with loop or hook material that has been adhered to some object, for example a firefighter's helmet. The firefighter would be able to pull the clip off of the helmet by way of the hook and loop material, or by disengaging base 114 from clip 112. Perhaps more important, if the firefighter snagged assembly 110 on an object, it could be pulled off by way of the hook and loop material.

In one preferred embodiment the base 114 and platform 116 both have a diameter of about 3.5 cm (1.4 in). Post 120 has a height of about 1.2 cm (0.5 in). Clip 112 is made of light gauge steel, whereas base 114, platform 116, post 120 and hinge 122 are made of lightweight polymer material. In an alternative preferred embodiment base 114 is made of light gauge steel. Center pin 118 is made of brass. In all, the assembly has a mass on the order of 37 grams (1.3 oz.), permitting easy handling.

The terms and expressions that have been employed in the foregoing specification are used as terms of description and not of limitation. There is no intention, in the use of such terms and expressions, of excluding equivalents of the features shown and described or portions thereof, it being recognized that the scope of the invention is defined and limited only by the claims which follow.

The invention claimed is:

1. A light assembly, comprising:

a. a clip;

b. a base, releasably engageable to said clip;

c. a platform, rotatably mounted on said base;

d. a post mounted on said platform and having a top;

e. a light, hinged to said top of said post; and f. wherein said platform is rotatably mounted to said base in such a manner that said platform is constrained to a finite number of resting positions as the platform is rotated relative to the base, said resting positions being separated by points offering resistance to rotation.

2. The light assembly of claim 1, wherein said finite set of resting positions includes between 5 and 30 resting positions.

3. The light assembly of claim 1, wherein said light is an LED light.

4. The light assembly of claim 1, wherein said light is hinged to said post in such a manner that said light is constrained to a second finite set of resting positions as said light is rotated relative to said post said resting positions being separated by points offering resistance to rotation.

5. The light assembly of claim 4, wherein said second finite set of resting positions includes between 5 and 30 resting positions.

6. The light assembly of claim 1, wherein said platform is constrained to rotate relative to said base in a single plane.

7. The light assembly of claim 6, wherein said base has a top surface that defines a plane and wherein said single plane of rotation of said platform is parallel to said plane defined by said top surface.

8. A light assembly, comprising:

a. a base having an area of at least 2 $cm^2$;

b. a platform, rotatably mounted on said base;

c. a post mounted on said platform and having a top, said post being between 1 cm and 3 cm in height;

d. a light, vertically hinged to said top of said post; and e. wherein said platform is rotatably mounted to said base in such a manner that said platform is constrained to a finite set of resting positions as the platform is rotated relative to the base said resting positions being separated by points offering resistance to rotation.

9. The light assembly of claim 8, wherein said light is an LED light.

10. The light assembly of claim 8, wherein said light is hinged to said post in such a manner that said light is constrained to a finite set of resting positions as the light is rotated relative to said post said resting positions being separated by points offering resistance to rotation.

11. The light assembly of claim 10, wherein said finite set of resting positions includes between 5 and 30 resting positions.

12. The light assembly of claim 8, wherein said platform is rotatably mounted on said base at a center of rotation and wherein said post is mounted on said base at a position displaced from said center of rotation.

13. The light assembly of claim 8, wherein said finite set of resting positions includes between 5 and 30 resting positions.

* * * * *

UNITED STATES PATENT AND TRADEMARK OFFICE

CERTIFICATE OF CORRECTION

PATENT NO. : 7,425,082 B1
APPLICATION NO. : 11/346820
DATED : September 16, 2008
INVENTOR(S) : Theodore D. Jones It is certified that error appears in the above-identified patent and that said Letters Patent is hereby corrected as shown below:

Col. 4 line 63

In claim 13, “claim 8” should be changed to --claim 10--.

Signed and Sealed this

Twenty-sixth Day of May, 2009

JOHN DOLL
*Acting Director of the United States Patent and Trademark Office*